US008707851B2

(12) United States Patent
Pawelski et al.

(10) Patent No.: US 8,707,851 B2
(45) Date of Patent: Apr. 29, 2014

(54) POSITIONER APPARATUS AND METHODS

(75) Inventors: Joseph W. Pawelski, Loveland, CO (US); Thomas M. Ingraham, Fort Collins, CO (US)

(73) Assignee: Flexibility Engineering, LLC, Loveland, CO (US)

( * ) Notice: Subject to any disclaimer, the term of this patent is extended or adjusted under 35 U.S.C. 154(b) by 742 days.

(21) Appl. No.: 12/950,736

(22) Filed: Nov. 19, 2010

(65) Prior Publication Data

US 2011/0120120 A1 May 26, 2011

Related U.S. Application Data

(60) Provisional application No. 61/263,255, filed on Nov. 20, 2009.

(51) Int. Cl.
*F01B 31/14* (2006.01)

(52) U.S. Cl.
USPC ..... 92/13.1; 92/13.4; 92/60.5; 92/13.6

(58) Field of Classification Search
USPC ..... 92/133–135, 85 R, 85 A, 85 B, 13.1, 92/13.4, 13.6, 60.5; 91/172
See application file for complete search history.

(56) References Cited

U.S. PATENT DOCUMENTS 1,475,508 A * 11/1923 Esnault-Pelterie ..... 417/274
2,095,820 A 10/1937 Lenz
2,484,603 A 10/1949 Audemar
5,211,280 A 5/1993 Houde
5,237,906 A 8/1993 Raymond
6,196,788 B1 3/2001 Talbot et al.
6,241,072 B1 6/2001 Ingraham
6,309,144 B1 10/2001 Ingraham
6,389,341 B1 5/2002 Davis
6,408,740 B1 6/2002 Holt et al.
6,589,008 B1 7/2003 Ingraham
6,886,841 B2 5/2005 Coombs et al.
6,957,533 B1 10/2005 Olsson
7,085,636 B2 8/2006 Song et al.
7,104,180 B2 9/2006 Hall et al.
7,152,405 B2 12/2006 Friedsam et al.
7,210,572 B2 5/2007 Ingraham
7,530,453 B2 5/2009 Ingraham
7,721,876 B2 5/2010 Hartness et al.
7,887,064 B2 2/2011 Inoue (Continued)

FOREIGN PATENT DOCUMENTS

DE 1 964 084 7/1967
JP 09014205 6/1995

OTHER PUBLICATIONS

U.S. Appl. No. 61/263,255, filed Nov. 20, 2009.

(Continued)

*Primary Examiner* — Edward Look
*Assistant Examiner* — Logan Kraft
(74) *Attorney, Agent, or Firm* — Santangelo Law Offices

(57) ABSTRACT

Disclosed herein are embodiments of inventive multipositioner technology relating to multipositioner apparatus having discrete positioning capability and, relative to each discrete position, incremental positioning capability. As compared with prior art apparatus, embodiments of the inventive technology may afford: operational resolution for larger positional ranges, reduced cylinder length to achieve positioning as desired, enhanced positioning capability and/or robustness of design.

29 Claims, 14 Drawing Sheets

(56) References Cited

U.S. PATENT DOCUMENTS

| | | | | |
|---|---|---|---|---|
| 7,891,484 | B2 | 2/2011 | Ranger | |
| 8,132,665 | B2 | 3/2012 | Pawelski | |
| 2002/0066363 | A1* | 6/2002 | Holt et al. | 92/13.1 |
| 2006/0266003 | A1 | 11/2006 | Topf et al. | |
| 2007/0095247 | A1 | 5/2007 | Ingraham | |
| 2009/0288725 | A1 | 11/2009 | Pawelski | |

OTHER PUBLICATIONS

Parallel U.S. Appl. No. 13/417,021, Office action dated Apr. 23, 2012.

European Search Report, dated Jan. 23, 2014, of parallel EP application No. 10014842.8.

* cited by examiner

POSITION 1

POSITION 2

POSITION 3

| | | | | |
|---|---|---|---|---|
| For Neck Guide Anysize | | | | |
| Cylinder Diameter | 2 | in | | |
| Piston Area | 3.141593 | in^2 | | |
| Max Pressure | 80 | PSI | Max Force | 251.3274 lb |
| Min Pressure | 10 | PSI | Min Force | 31.41593 lb |
| Max travel | 0.5 | in | | |
| K Value | 439.823 | | | |

9584K91 Similar Spring From McMaster (proof of concept)

0.5

Fig. 5

POSITIONER APPARATUS AND METHODS

This application claims priority to U.S. Provisional Application Ser. No. 61/263,255, filed Nov. 20, 2009, said application incorporated herein in its entirety.

BACKGROUND

Multiposition cylinders in general are well known. They find common use to control position of, e.g., conveyance system rails as may be used in bottling processing plants. Conventionally, such cylinders provide the ability to achieve a plurality of discrete positions (e.g., 0", 0.5", 1.0", 1.5" for a 4 position cylinder) only. Typically, prior art multiposition cylinders (as shown in FIG. 1) involve designs where two or more cylinders ("sub-cylinders") are stacked on one another. The bottom or rear cylinder is typically shorter than the one stacked atop it. More generally, a rearward cylinder is shorter or at most the same length as a cylinder that is forward of it.

In the prior art three position cylinder of FIG. 1, position 1 (the no-control or rest position) is achieved with both pistons retracted towards the rear (right in this figure) of the positioner while position 2 is achieved with the rear piston extended. With regard to position 2, upon application of pressure behind the rear piston, the rear piston is moved to its maximal displacement relative to the rear end cap; the piston rod from the rear piston pushes the front piston forward by an equal amount, effectively moving the front piston—and the positioning rod extending therefrom—forward whatever distance the rear piston extended. Position 3 is achieved upon application of pressure behind the front cylinder (when the device is in position 2), thereby causing it to move to its maximal extended position, thereby further extending the positioning rod's position by an equal amount (note that the front piston is not attached to the piston rod that extends from the rear piston). The piston rod extending forward from the front piston passes through a seal in the top cylinder end cap; displacement of the front piston, whether primarily effected by the front piston (position 3, after earlier repositioning thereof is effected by the rear piston) or the rear piston (position 2), results in repositioning relative to the stationary front end cap of the positioning rod that extends out of the front of the device. It is of note that there is typically a vent in the left-most wall of the chamber that the left piston travels in.

Disadvantages of conventional multiposition cylinders may include:

Size: For each discrete position (other than that position associated with zero extension), a cylinder of length at least as great as the distance from the previous position (stroke) is required. Most conventional multiposition cylinders include two or more cylinders stacked one atop each other (see, e.g., FIG. 1); for each discrete position a cylinder of corresponding stroke is required.

Example: A conventional four position multiposition cylinder with 1", 2", and 4" strokes would typically include 3 cylinders. The first would have a stroke of 1", the second a stroke of 2", the $3^{rd}$ a stroke of 4"; the combined length of this 4 position cylinder would be 1"+2"+4"=7", plus whatever the thickness of the end caps and pistons (e.g., 3" inches on a typical conventional 2" multiposition cylinder). So, upon adding the end cap thickness (for each cylinder) to the piston lengths, the overall length is (1+3)+(2+3)+(4+3)=16" . . . quite large for a cylinder having a maximum effective stroke of only 4". If "efficiency" shows the relationship between effective stroke length and overall cylinder length (efficiency=effective stroke/overall cylinder length), the cylinder efficiency of this conventional four position cylinder is a mere 25%, and the cylinder must be 4× the required stroke length. Due to space constraints efficiencies greater than 50% are desired. At least one embodiment of the inventive technology may achieve this goal.

Control Inputs: Conventionally available, "off-the-shelf" multiposition cylinders typically require one air input for each position. For the 4 position example given above, each cylinder has an inlet which needs a valve to engage it. Each inlet has its own valve: turn valve 1 on and pressure is supplied to the 1" stroke cylinder; turn valve 2 on and pressure is supplied to the 2" cylinder; turn valve 3 on and pressure is supplied to the 4" cylinder. If the cylinder is not supporting a mass or spring loaded object (supplying a sufficient retraction force), either a $4^{th}$ valve or regulated air must be supplied to the rod side of the last-to-extend piston (the 4" cylinder in the above example) to retract the pistons and return to the desired discrete position (whether that be 3", 1" or 0"). Each input requires a valve, airline, and inlet/outlet if the system is electrically controlled via a panel (as is generally the case for industrial equipment). Of course, such an apparatus can be rather complex, having many parts and involving a rather complicated control scheme.

It is of note that certain embodiments of the inventive technology may have arisen from the need to achieve a greater stroke length than is offered by cylinders having relatively high spring constants (such cylinders incorporating such stronger springs in order to achieve higher resolution positional control). As is well known, the higher the spring constant, the less displacement that spring will show under a certain force, thereby allowing for a greater resolution and more precision positional control. However, use of such springs comes with a limited range of motion, as in order to achieve positional ranges associated with lighter springs (which offer lower resolution control), comparatively higher pressures must be used, and often such higher pressures are impractical, not feasible, or simply dysfunction given the design. Aspects of the inventive technology, which may involve "staging" motion of the positioner (such that incremental control of the second movable component can be achieved from different "base", or distinct, staged, positions of the first cylinder (at which the first movable component may be secure)), may resolve such concerns.

BRIEF DESCRIPTION OF THE DRAWINGS

FIG. 3's various figures have a control volume as the elastic element.

FIG. 4's various figures have a helical spring as the elastic element.

FIG. 5 shows exemplary specifications for an embodiment of the inventive technology of FIG. 2.

FIG. 9D shows a possible intermediate position that the positioner may have when the first movable component is in its second (middle) of three possible discrete stationary positions, in cross-section.

FIGS. 13A and 13B show two possible intermediate positioner positions when the first movable component is in its rightmost discrete stationary position, while FIGS. 13C and 13D show two possible intermediate positioner positions when the first movable component is in its leftmost discrete stationary position.

DESCRIPTION OF THE PREFERRED EMBODIMENTS

The inventive technology, in embodiments, relates to a novel multiposition cylinder, a type of positioner that may find application in a variety of areas including but not limited to side guide positioning for container (e.g., bottle) processing. Advantages include but are not limited to the application of the positional resolution (e.g., as disclosed in US Pat. App. Pub. No. US/2009/0288725) relative to single piston/single spring systems to a wider (as compared with prior art apparatus) displacement range (e.g., whereas with conventional apparatus each change in 0.1 psi could possibly result in a repeatable distance change of 0.1" over a displacement range of 0.5", with an inventive multiposition cylinder disclosed herein, that same resolution (i.e., a change in 0.1 psi could result in a repeatable distance change of 0.1") could be exhibited over a displacement range of say, 1"). An additional advantage relates to affordability of an incremental positioning over a certain range (e.g., any multiple of 0.1" from 0" to 1.5"), as opposed to the limited discrete positioning capabilities (e.g., only 0.0", 0.5", 1.0", 1.5"). Further advantages include: reduction in size of cylinders relative to prior art single piston cylinders having an equal displacement range; and reduction in the number of moving parts and control componentry due to a simpler, more robust and functionally and operationally improved system. Of course, additional advantages may be disclosed in the remainder of the specification, including the figures.

Figure 1A:
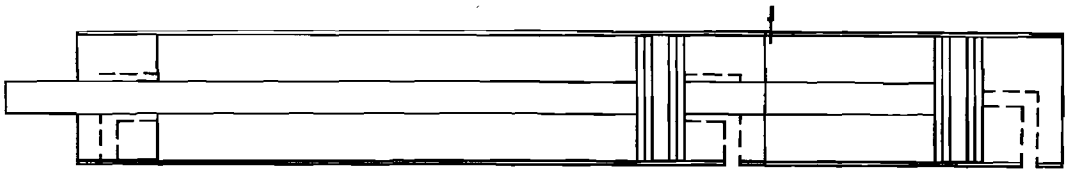
FIGS. 1A, 1B and 1C show a prior art 3-position multiposition apparatus (position 1, position 2 and position 3, respectively), in cross-sectional view.
Figure 1B:
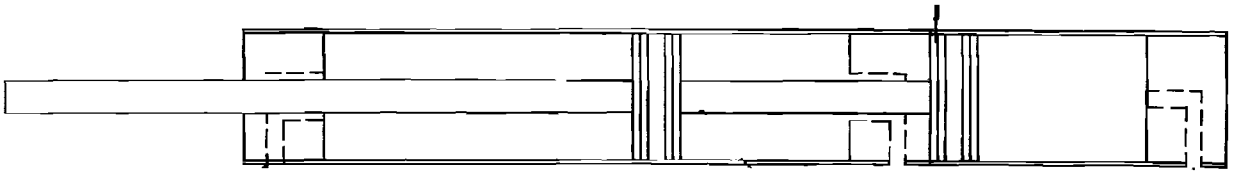
Figure 1C:
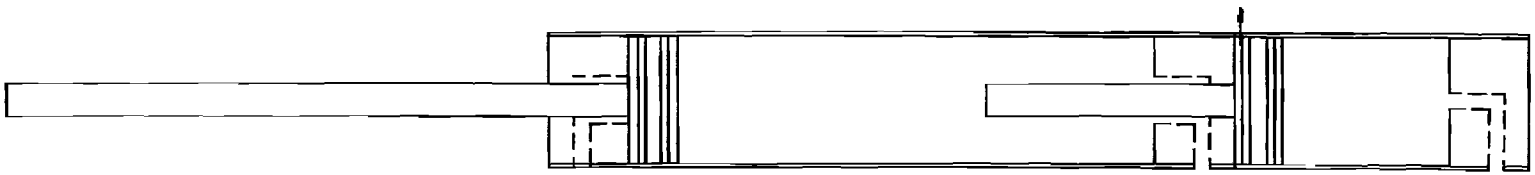
Figure 2:
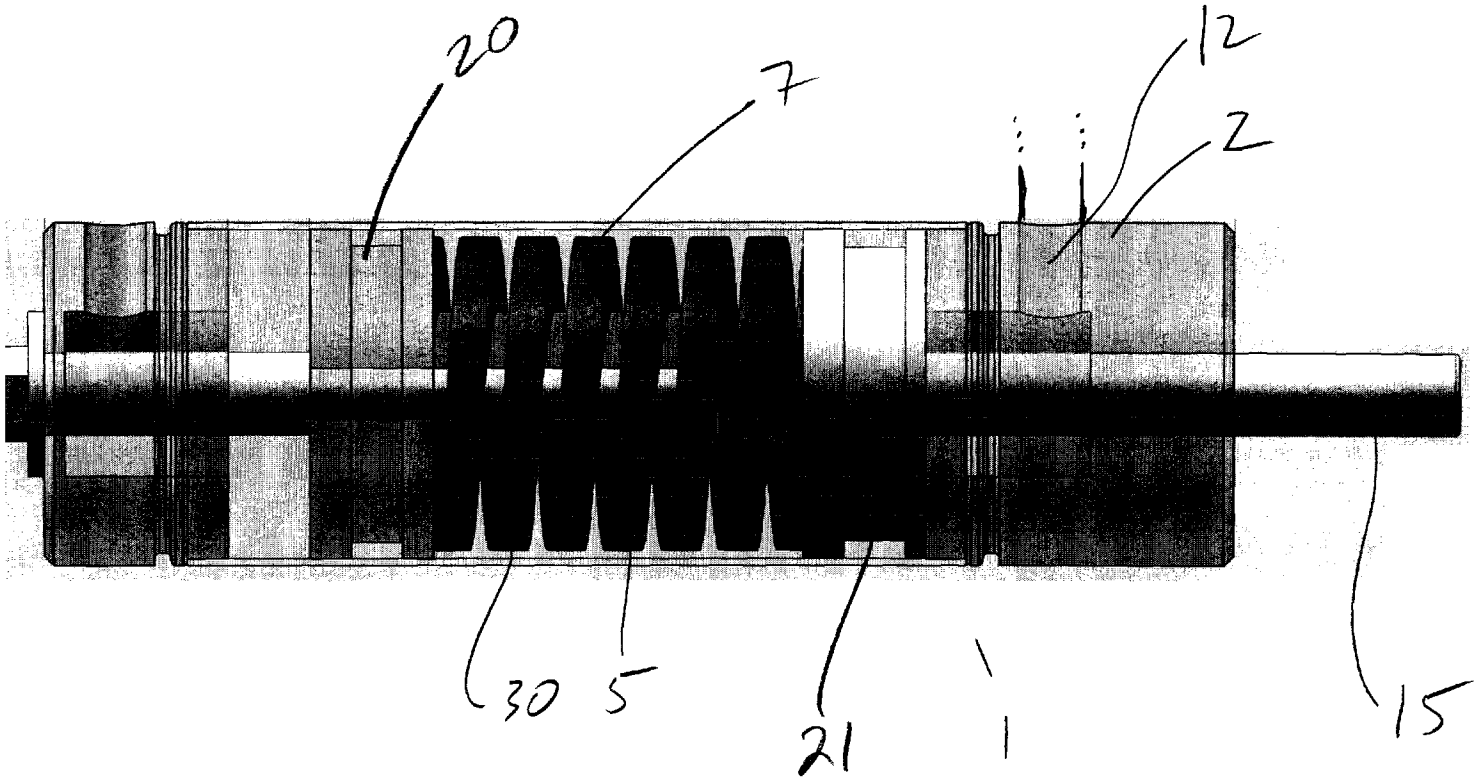
FIG. 2 shows an embodiment of the inventive technology in transparent view.
Figure 3G:
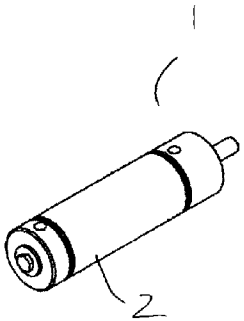
FIG. 3G shows a perspective view.
Figure 3A:
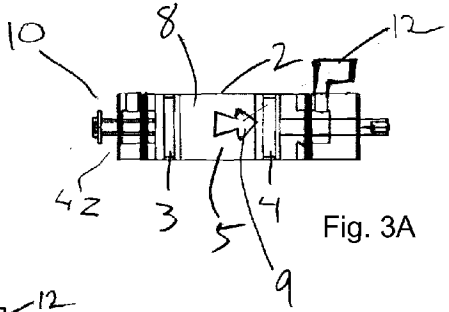
FIGS. 3A-3C show, in cross-sectional view, a 2-position (i.e., 2 discrete positions of the first piston) embodiment of the inventive technology, in various configurations.
Figure 3B:
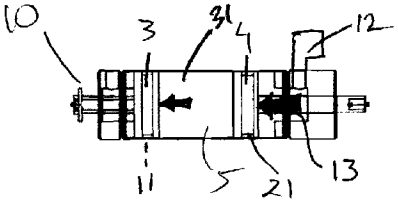
Figure 3C:
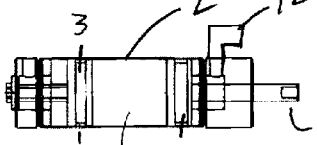
Figure 3E:
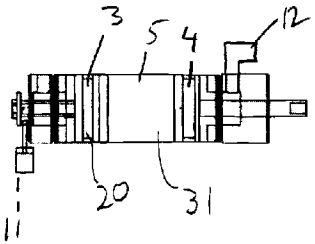
FIGS. 3D-3F show a slightly different embodiment (3-position) of the inventive technology, in various configurations.
Figure 3D:
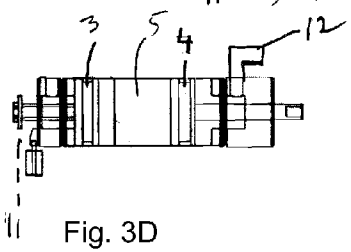
Figure 3F:
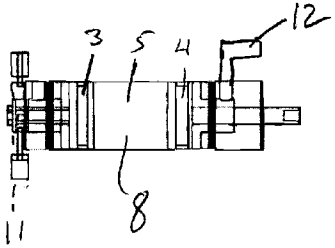
Figures 4A, 4B, 4C, 4D, 4E, 4F, 4G:
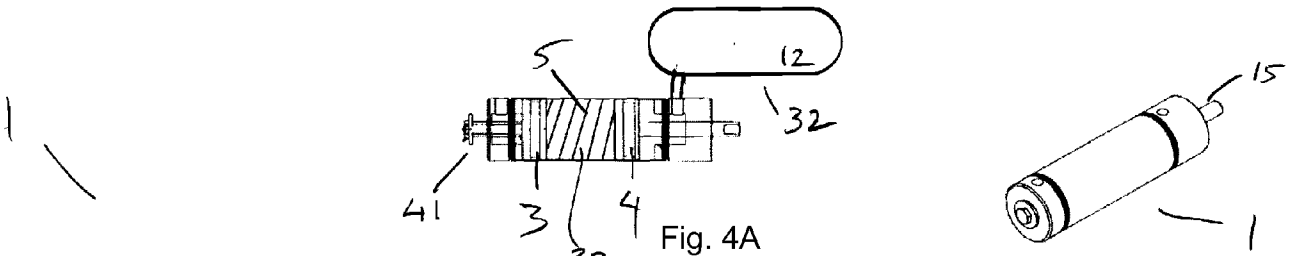
FIGS. 4A-4C show, in cross-sectional view, a 2-position (i.e., 2 discrete positions of the first piston) embodiment of the inventive technology, in various configurations.
FIGS. 4D-4F show a slightly different embodiment (3-position) of the inventive technology, in various configurations.
FIG. 4G shows a perspective view.

The positioner of FIG. 2 may afford incremental travel from 0-0.5" from discrete position 1 and 0.5-1" from discrete position 2. In FIG. 2, the front and rear pistons are preferably not connected, but may be each connected to a shaft (e.g., a ½" shaft) that protrudes through a steel rod seal out of the rear end cap (the left of the cylinder as shown), where a forward stop (e.g., a bolt and washer) for the second piston may be fastened. To the right of the second piston may be a guide that prevents spring buckling and acts as a stop to prevent the spring from over-compressing. Regulated air may be fed to the front of the front cylinder, thereby achieving an incremental position as desired, or forcing the leftmost piston (the rear piston) to its leftmost discrete position (to force the leftmost piston to the rightmost discrete position, air of sufficient pressure to overcome the spring force may be fed into the left of the left piston); pressurized air may be fed to the rear of the rear cylinder, where such pressurized air may be used to change from one discrete position to the other (elimination of that pressure sufficient to keep the rear piston in the forward discrete position would, because of the spring's force, cause retraction of the rearward piston towards the rear of the cylinder). The spring may be attached to the rear piston. Specifications for one of many springs that may find application in the positioner of FIG. 2 are shown in FIG. 5. It is also of note that certain embodiments of the inventive technology may involve apparatus disclosed in US Pat. App. Pub. No. US/2009/0288725, hereby incorporated herein in its entirety.

It is of note that certain embodiments of the inventive technology achieve one or more of their advantages (particularly the advantage relative to enhanced resolution) by using the same spring, control air or regulated air to control incremental motion for more than one discrete position. Whereas in the past, one end of the spring (i.e., the spring that provides the predictable bias force against the pressurized piston) was immovable relative to the cylinder, in certain embodiments herein, such end may now be moved (such movement occurring when a different discrete positioning is desired to achieve a different incremental positioning that is not achievable from the current discrete (indexed) position). Movement of such end now enables the resolution of such spring to be afforded to a new motion range based on that new discrete position (e.g., where with position 2, having a discrete, indexed "base" position of 0.5", the range of incremental positions may be limited to 0.5" to 1.0"; with position 3, having a discrete, indexed "base" position of 1.0", the range of incremental positions may be limited to 1.0" to 1.5"). Within each range, the spring's resolution would apply because it is shifted to the new discrete, indexed position. Compared to the prior art approach to achieving incremental positioning over such range (in its entirety), 0"-1.5", which involved the use of 1 spring whose one end was immobile relative to the cylinder, the new approach has a greater resolution, providing the ability to achieve much more accurate control and positions (e.g., 0.3675", or every 0.005" as desired) that were unachievable with conventional single spring apparatus (which perhaps could achieve 0.367" or 0.368" at best, or every 0.01 as desired).

Advantages may include the achievement of three or more different discrete positions without the need for an additional input control air for each additional position (of course, associated with each such additional input control air is additional valve(s), air line(s), wires, regulator(s) and/or microprocessor control componentry). Indeed, proper selection of the springs and adjustment of input pressures of the various embodiments can achieve three or more discrete positions.

The inventive technology, in particular embodiments, may be generally described as a positioner (e.g., a multipositioner) in which, in addition to providing the ability to position to discrete positions (as found in conventional multiposition cylinders), provides incremental positional control (at a higher resolution than characteristic of the movement from discrete position to another) between such discrete positions (perhaps affording infinite positional control). Particular embodiments (as shown in, e.g., FIG. 7) may achieve positional control (preferably discrete multiposition and incremental control, although certainly even only discrete multiposition control), where the number of discrete positions is three or greater, with only two pressurized fluid (e.g., pneumatic) inputs (a first input (e.g., a control input) may only affect achievement of discrete multipositions, not incremental control, while a second input (e.g., a regulated input) may be used only to achieve incremental control).

FIG. 3 shows an embodiment in which pressurized fluid input at the left of the cylinder is used to move the first movable component (first piston in this embodiment) from one discrete stationary position to another, and fluid input at the right of the cylinder is used to move the second movable component (second piston in this embodiment) right or left at the higher resolution. The fluid input (effected by the second movable component force applier) at the right may also be useful to force the first piston all the way to the left (in its left most discrete stationary position), particularly when the compressed fluid input at the left is open to atmospheric pressure. During such movement, the second piston may identically move with the first piston. From this or any other of the discrete stationary positions, the second piston can be moved at a higher resolution (than the resolution characteristic of the two or more discrete stationary positions) upon the addition of pressurized fluid at the right inlet of the cylinder. In order to change the position of the first (left in this orientation) piston from its leftmost stationary position to a different stationary position, pressurized fluid at a pressure that is greater than the pressure of the fluid input at the right fluid inlet is input at the left fluid inlet, thereby moving the first piston. Of course, in those designs where the postion of the left piston is locked, it must be unlocked first. Then, upon reaching the desired stationary position, the first piston can be retained there (e.g., by an appropriately high pressure at the left of the first piston and a stop, or locked, in other embodiments). Then, pressurized fluid input at the right can be adjusted as necessary to move the second piston incrementally, at the higher resolution (without moving the first piston). Other embodiments may operate in somewhat analogous manner.

At least one embodiment of the inventive technology may be described as a positioner apparatus 1 that includes: a cylinder 1; a first movable component 3 and a second movable component 4 (e.g., a second piston or a cylinder end portion) established in the cylinder; an elastic element 5 (a spring, such as a helical spring 7, or a control volume 8 of fluid, as but a few examples) established within the cylinder so as to effect an elastic force 9 (e.g., a force whose strength varies with displacement of the elastic element, such displacement lengthening or shortening the elastic element) against the second movable component; a securable position adjustment mechanism 10 configured to selectively secure (e.g., as necessary to achieve positioner position as desired) the first movable component in at least two discrete first movable component positions 11 within the cylinder at a first movable component movement resolution; a second movable component force applier 12 configured to apply a second movable component force 13 that acts against the elastic force so as to move the second movable component at a second movable component movement resolution; and a positioner 14 (e.g., whose position is of greatest import to the operation of the system in which the positioner apparatus is used) that is positionally responsive to the second movable component (e.g., such that when the second movable component moves, so does the positioner), wherein the second movable component movement resolution is greater than the first movable component movement resolution. A force is said to act against a piston (or component) where that force acts against motion even in only one direction. Preferably, the first movable component and the second movable component are each movable, relative to either the cylinder and/or the other component. As such, the first movable component may be a movable first movable component and the second movable component may be a movable second movable component.

At least one embodiment of the inventive technology may be described as a positioner apparatus that includes: a cylinder; a first movable component and a second movable component established in the cylinder; a securable position adjustment mechanism configured to selectively secure the first movable component in at least two discrete first movable component positions within the cylinder at a first movable component movement resolution; an elastic element established within the cylinder so as to effect an elastic force against the second movable component; a second movable component force applier configured to apply a second movable component force that acts against the elastic force so as to move the second movable component at a second movable component movement resolution; and a positioner that is positionally responsive to the second movable component, wherein, when the first movable component is secured in any one of the at least two discrete first movable component positions, the second movable component is movable both towards the first movable component and away from the first movable component (not simultaneously, of course).

Figures 11A, 11B, 11C:
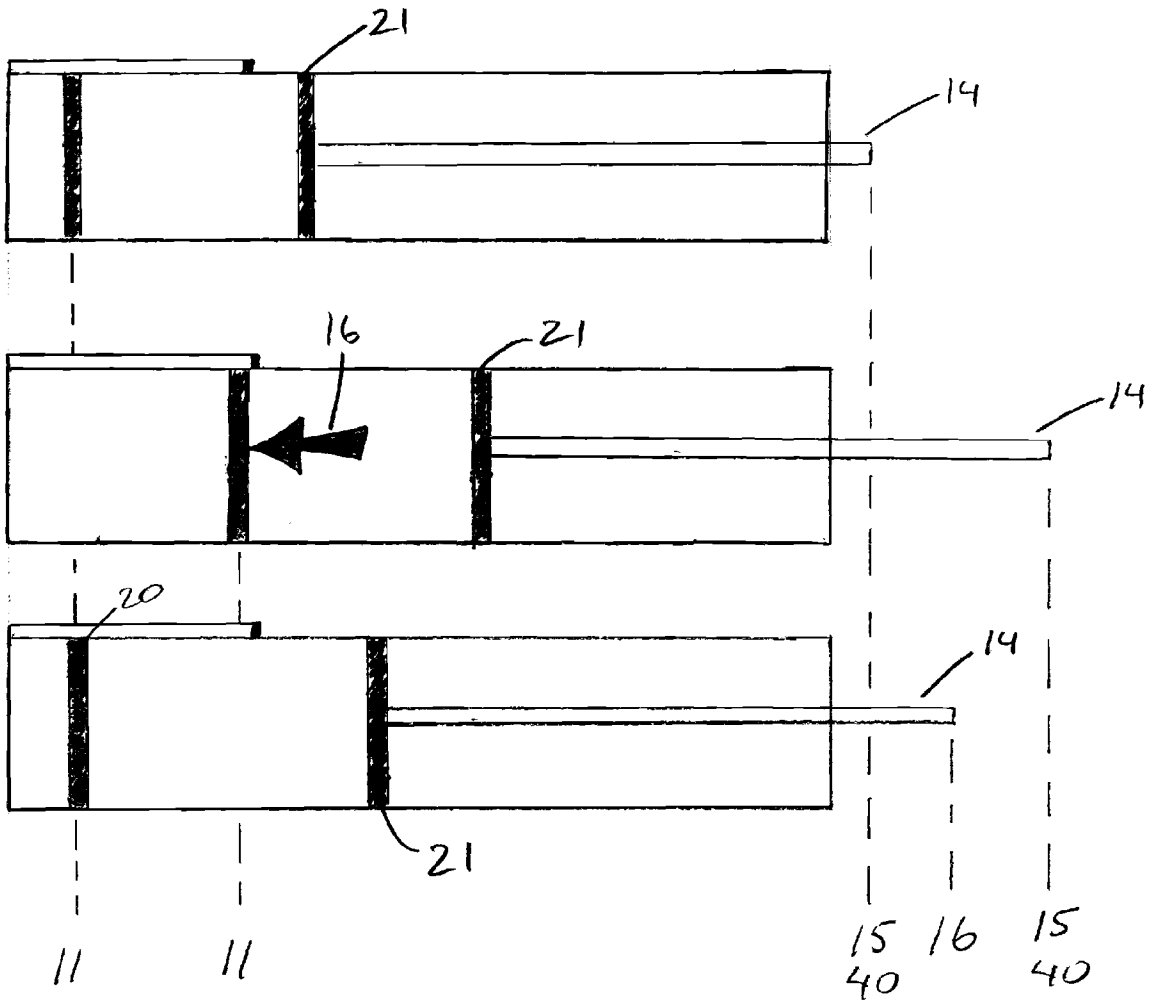
FIGS. 11A and 11B show leftmost positions of the second movable component when the first component is in its leftmost and rightmost discrete stationary positions.
FIG. 11C shows an intermediate position of the second movable component when the first component is in its leftmost position, in cross-section.
Figures 12A, 12B, 12C:
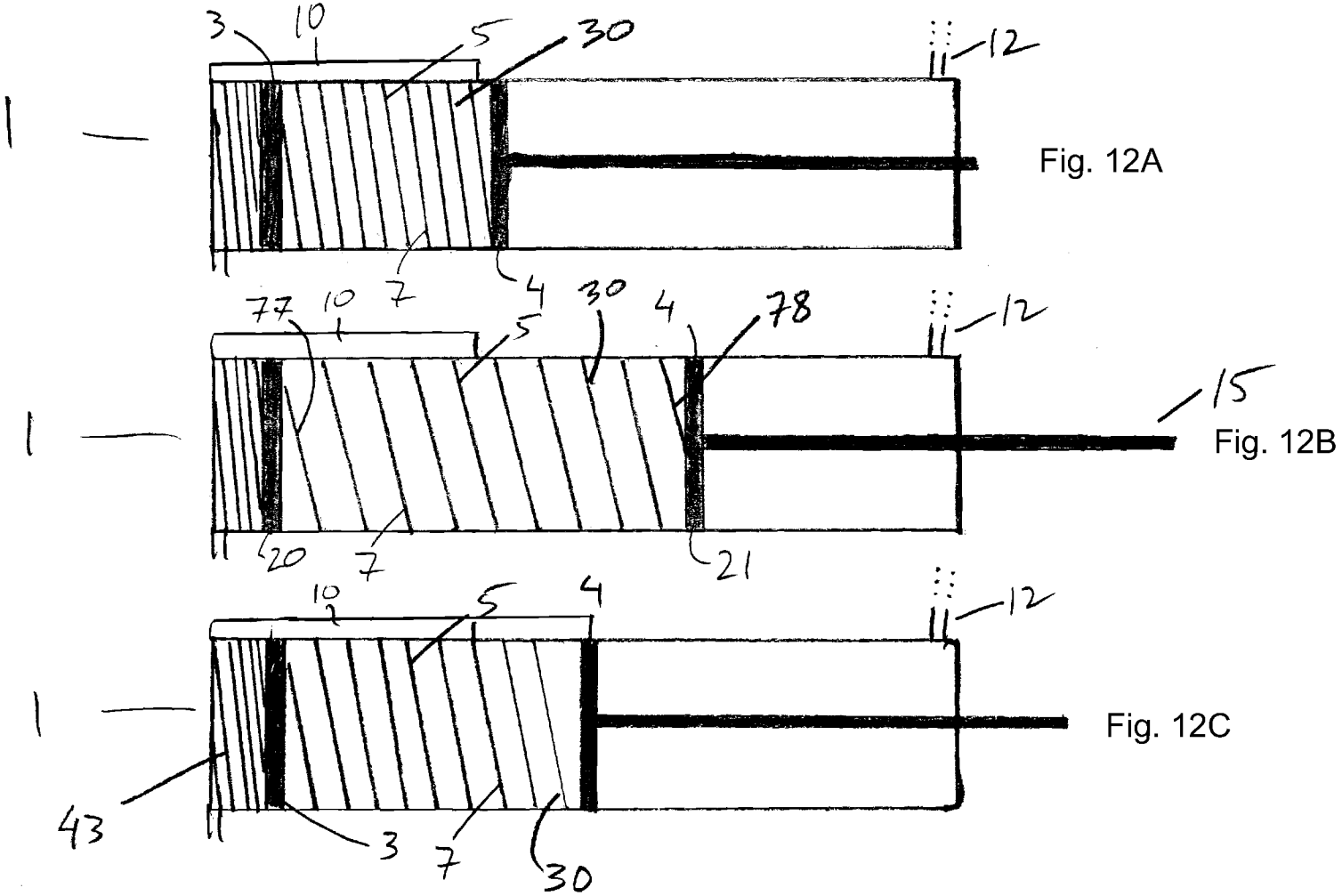
FIGS. 12A and 12B show a leftmost, rightmost, and intermediate position of the second movable component when the first component is in its leftmost discrete stationary positions, respectively, in cross-section.

At least one embodiment of the inventive technology may be described as a positioner apparatus that includes: a cylinder; a first movable component and a second movable component established in the cylinder; an elastic element established within the cylinder so as to effect an elastic force against the second movable component; a securable position adjustment mechanism configured to selectively secure the first movable component in at least two discrete first movable component positions within the cylinder at a first movable component movement resolution; a second movable component force applier configured to apply a second movable component force that acts against the elastic force so as to move the second movable component at a second movable component movement resolution; and a positioner that is positionally responsive to the second movable component, wherein movement of the first movable component to the at least two discrete first movable component positions 11 effects movement of the positioner to at least two corresponding discrete positioner positions 15, and wherein the positioner is movable to intermediate positions 16 between any two proximate positioner positions 40 of the at least two corresponding discrete positioner positions, at the greater resolution (see FIG. 11C, e.g.). Such movement to such intermediate positions may be effected by movement of the second movable component.

In certain of the embodiments described herein (whether in the text or the figures), whether apparatus or method, the second movable component force applier (which applies force to the second movable component) may also be configured to apply a first movable component force that moves the first movable component from one of the at least two discrete first movable component positions to another (e.g., at the first movable component movement resolution) (see, e.g., FIG. 3). Or, instead, a first movable component force applier can be distinct from the second movable component force applier (see, e.g., FIG. 9, where the securable position adjustment mechanism also acts to impart a force that moves the first movable component (the cylinder end portion, in this embodiment)) and can apply the force that acts on the first movable component to move the first movable component from one of the at least two discrete first movable component positions to another at the first movable component movement resolution. The more efficient, robust design may be the design where the second movable component force applier may also be configured to apply a first movable component force 16 that moves the first movable component from one of the at least two discrete first movable component positions to another at the first movable component movement resolution (a spring, e.g. (a light spring might be preferable), might be used to counteract such force). However, the design where there are distinct first movable component and second movable component force appliers is also viable. It is of note that the second piston force applier may act through the elastic element to apply the first movable component force.

Figures 9A, 9B, 9C, 9D:
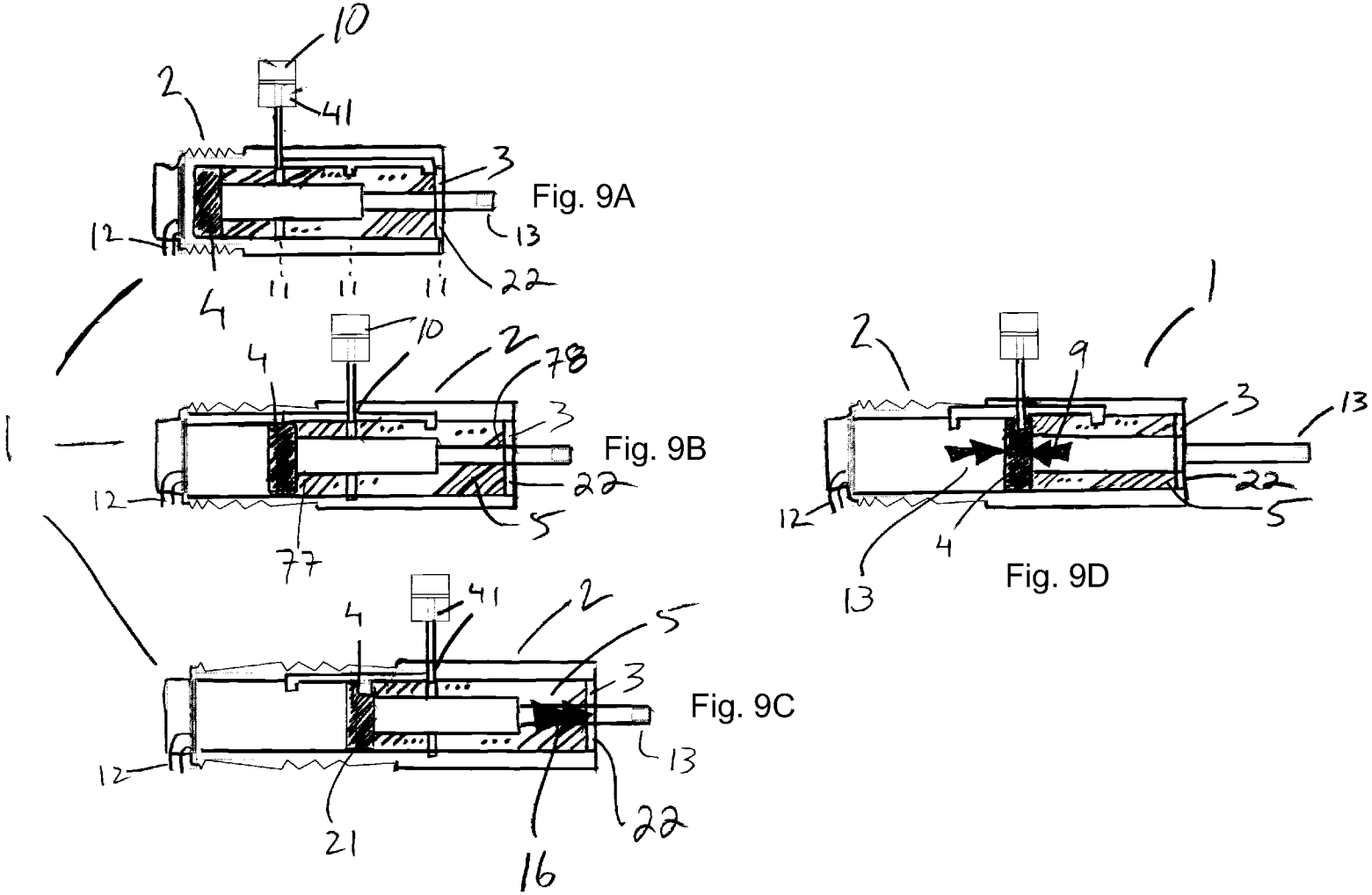
FIGS. 9A, 9B, 9C and 9D show an embodiment of the inventive technology in cross-sectional view, with the first movable component in three different discrete stationary positions, in cross-section.
Figures 10A, 10B, 10C, 10D:
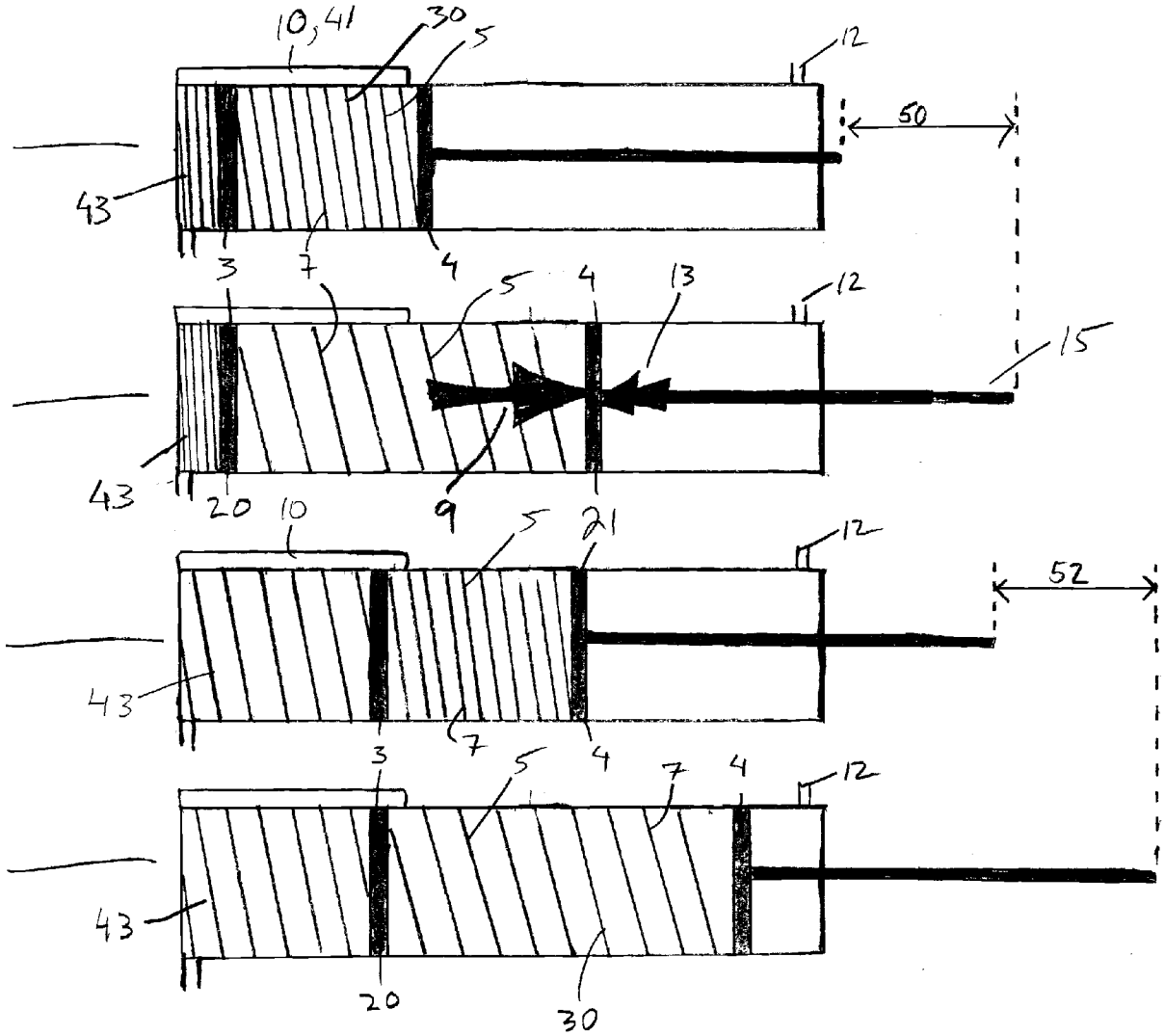
FIGS. 10A and 10B show leftmost and rightmost positions of the second movable component when the first movable component is in its leftmost of two possible discrete stationary positions, in cross-section. 10C and 10D show leftmost and rightmost positions of the second movable component when the first movable component is in its rightmost of two possible discrete stationary positions, in cross-section.

In particular embodiments, the first movable component may be a piston (a first piston 20), while in other embodiments, the first movable component may be something other than a piston (e.g., in the telescoping design of FIG. 9). For example, in such other designs, it may be a portion (such as the inner portion) of the end of the cylinder (e.g., a telescoping cylinder). It is of note that even where the first movable component is indeed a cylinder end portion, such cylinder end portion 22 is considered within or in the cylinder (because that portion of the end of the cylinder that is in or within the cylinder is defined as a cylinder end portion). The second movable component may be a piston (a second piston 21), or, e.g., a cylinder end portion (e.g., in telescoping cylinder designs). In several embodiments, both the first movable component and the second movable component are pistons. It is of further note that in certain embodiments, the elastic element has two ends 77, 78 (one that is closer to one end of the cylinder and another that is closer to a different end of the cylinder) that are translationally movable along a length of the cylinder (perhaps simultaneously, as may be seen when the first movable component is moved from one discrete stationary position to another).

It is also of note that the term piston is generally defined as anything that is movable (e.g., slidably) within a cylinder along the length axis thereof; pistons need not necessarily contact inner walls of the cylinder (although in certain preferred embodiments they do). The term cylinder as used herein includes any structure having an outer surface and inner surface, the inner surface defining an inner space. It need not have a circular shape in cross-section.

In particular embodiments, the elastic element may include a helical spring 30 and/or a control volume 31 of air or other gas (other possibilities include any substance with a elastic response (e.g., a consistent elastic response, such as one following Hooke's law)). In particular embodiments, the elastic element may be established between the first movable component and the second movable component (see, e.g., FIGS. 2, 3 and 7). It is of note that often, where an elastic element is other than a control volume of fluid (e.g., a captured volume of air), a vent is supplied in order that the elastic element act as intended.

It is of further note that the springs 30 or control volume 31 of fluid used in any of the inventive apparatus or methods herein, may be as disclosed in, and may interact with an associated piston, as disclosed in US Pat. App. Pub. No. US/2009/0288725. However, such reference, while explanatory as to certain embodiments, does not limit possible designs that are otherwise covered by the claims from the scope of the inventive technology.

In certain embodiments, the second movable component force applier itself is a conventional type of pneumatic force applier 32 (including, e.g., a pneumatic source of pressurized air, and a control system to control the pressure applied (such system perhaps including a valve and/or a regulator)). In particular embodiments, the same pneumatic force applier effects movement of the first movable component from one of the at least two discrete first movable component positions to another (see, e.g., FIG. 7, where the pneumatic force applier moves the first movable component to the left, and where a light spring 43 may cause movement of the first movable component towards the right). The same pneumatic force applier may effect movement of the first movable component to at least three discrete first movable component positions (of course, at least three discrete first movable component positions are possible for other designs (e.g., those including a distinct first movable component and second movable component force appliers).

In particular embodiments described herein, when the first movable component is secured in any one of the at least two discrete first movable component positions, the second movable component is movable both towards the first movable component and away from the first movable component. Such may allow for the precise control of the position of the positioner that is desired at times. A sufficiently high spring constant allows for precise control; a movable first movable component that can be secured against movement in any of two or more discrete stationary positions allows for greater total range of motion of the positioner at the higher resolution.

Figure 7:
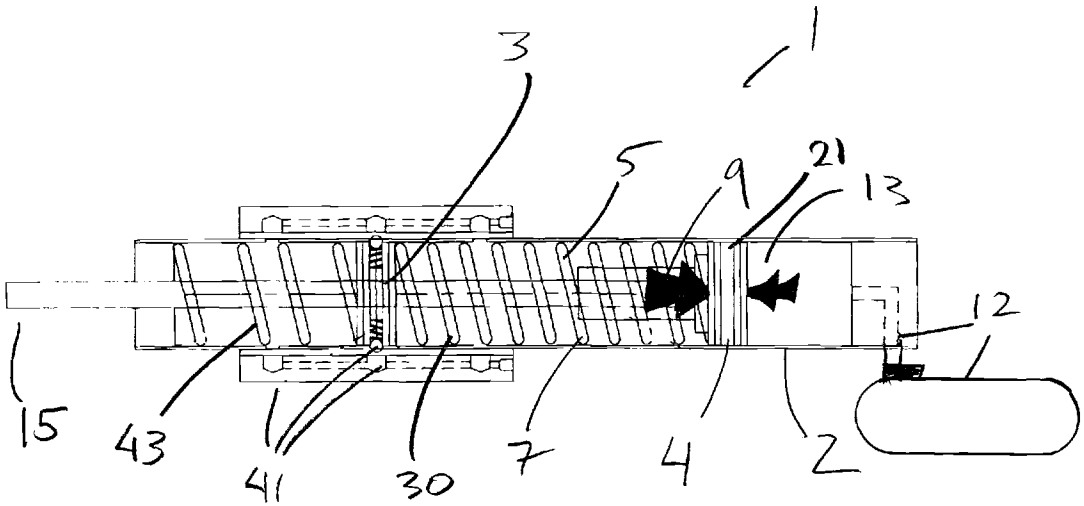
FIG. 7 shows an embodiment of the inventive technology in cross-sectional view.
Figure 8A:
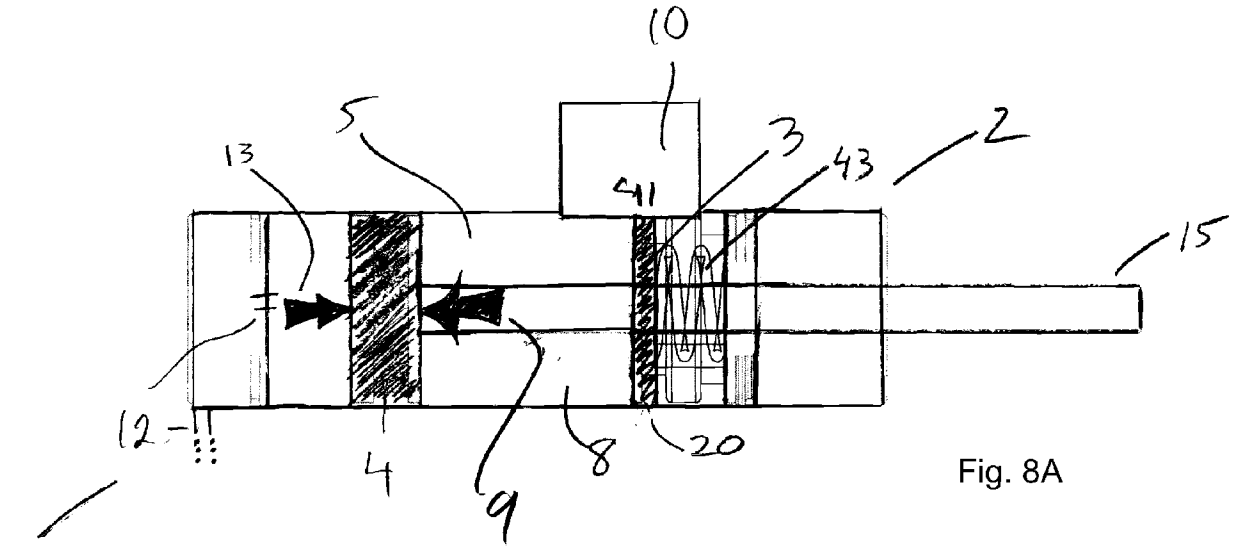
FIGS. 8A and 8B show an embodiment of the inventive technology in cross-sectional view with the first movable component in two different discrete stationary positions, in cross-section.
Figure 8B:
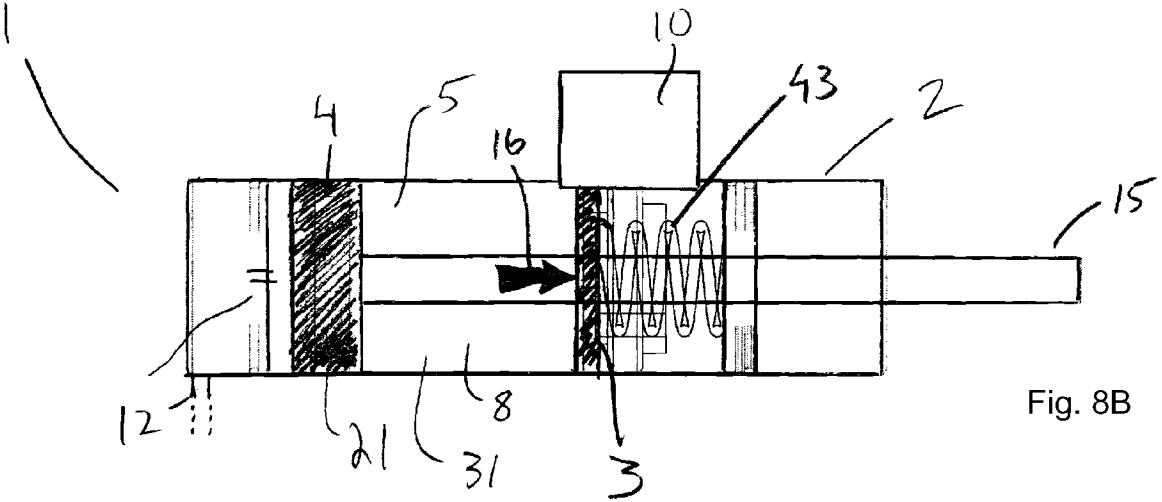

In particular embodiments, movement of the first movable component to the at least two discrete first movable component positions effects movement of the positioner to at least two corresponding discrete positioner positions (see, e.g., FIGS. 3 and 7). In such (and perhaps other) embodiments, the positioner may be movable to intermediate positions between any two proximate positioner positions of the at least two corresponding discrete positioner positions. It is of further note that in certain of the embodiments described herein (whether in the text or the figures), the first and second movable components are the only pistons established in the cylinder. Such may be a main reason for the robustness of particular embodiments.

The securable position adjustment mechanism is a position adjustment mechanism (whether mechanical, electrical or both, as but a few examples) that enables the desired position of the part that it acts on (e.g., the first movable component) to be secured (e.g., locked, or retained in some fashion) via, e.g., a retainer mechanism 41 such that movement of the other piston (e.g., the second movable component) will not effect movement of the part the securable position adjustment mechanism acts on (e.g., the first movable component). It may, and preferably is, also releasable so that the retained position can be changed to a new retained position as desired or necessary. The retainer mechanism can be obstacle and spring, obstacle and controlled source of pneumatic force (perhaps with a spring), ratchet system, as but a few examples.

Figures 13A, 13B, 13C, 13D:
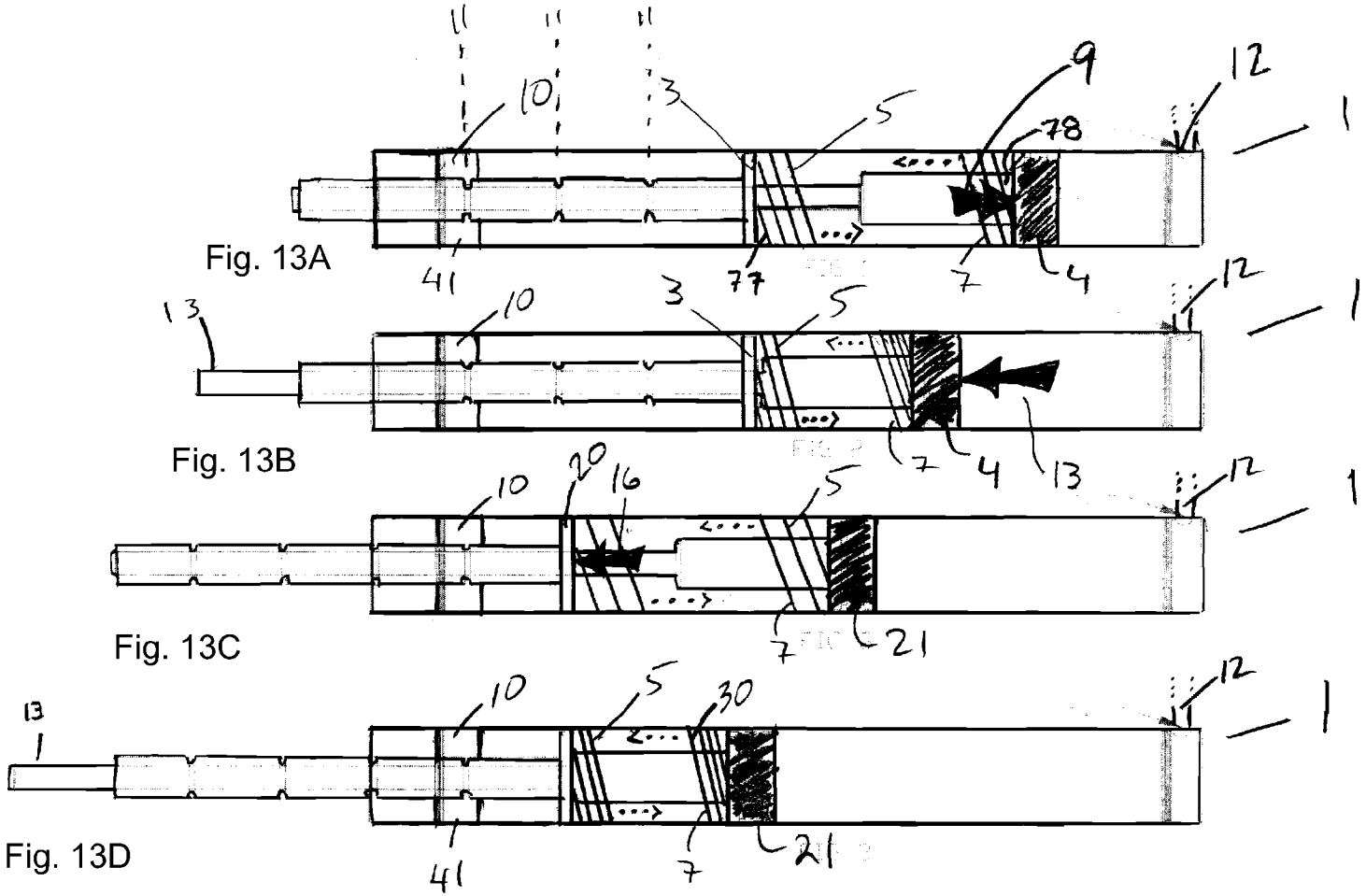
FIGS. 13A, 13B, 13C and 13D show a 3 discrete position, ratchet-type apparatus (where a ratchet mechanism changes the position of the first movable component).
Figure 14A:
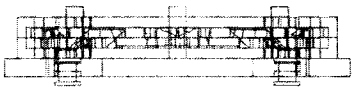
FIGS. 14A, 14B, 14C and 14D show a side view, a perspective view, a top view, and a different side view of an embodiment of the ratchet mechanism.
Figure 14B:
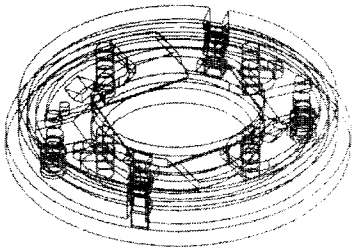
Figure 14C:
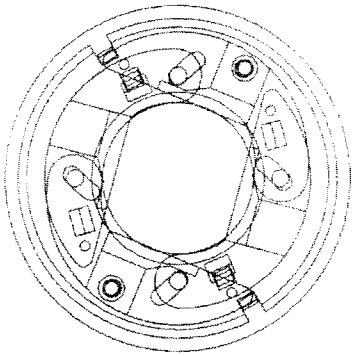
Figure 14D:
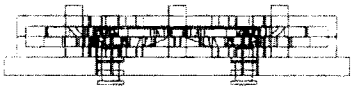

In certain of the embodiments described herein (whether in the text or the figures), the securable position adjustment mechanism may include a first movable component force applier that is distinct from the second movable component force applier and that applies a first movable component force that moves the first movable component from one of the at least two discrete first movable component positions to another at the first movable component movement resolution (see, e.g., FIG. 9). Such first movable component force applier may be a pneumatic force applier (as but one example; fluids other than compressed air (e.g., water or hydraulic fluid), can be used). A pneumatic force applier (e.g., including a small pneumatic cylinder) is a type of mechanical force applier. In particular embodiments, the securable position adjustment mechanism may include a mechanical securable position adjustment mechanism 42, for example a spring and dedicated force applier mechanism (which, e.g., could be pneumatic), at least two first movable component movement obstacles (see, e.g., FIG. 3), a shuttle mechanism (see, e.g., FIG. 7), and/or a ratchet mechanism (see, e.g., FIG. 13). Instead, or additionally in some cases, the securable position adjustment mechanism may include an electrical securable position adjustment mechanism (e.g., with an electric lock). The securable position adjustment mechanism may even include a spring 43 or control volume 44 established behind the first movable component, in certain embodiments (particularly those where the second movable component force applier is also the first movable component force applier); this spring may act to enable a force on the first movable component to move it from a first discrete "base" position to a second discrete "base" position. Of course, from each base position, the second movable component may move with a greater resolution so as to provide the precise motion control desired. Moving the first movable component so as to change its secured position effects a larger range over which the positioner may move at its greater resolution.

In particular embodiments, the second movable component movement resolution is greater than the first movable component movement resolution. Resolution as used herein is inversely related to the distance between the different available positions for the referenced device or within the referenced range (it may be viewed as being directly related to the "closeness" of such positions; the closer they are, the higher or greater the resolution). For example, if a first movable component is movable to three different positions of 0", ½" and 1", and a second movable component is movable to 30 different positions of 0", 0.033", 0.066", 0.099", etc., (for each piston, distances are relative to a piston's "home" position), the second movable component is said to have a greater resolution than that of the first movable component (i.e., the average distance between its possible positions is, in value, smaller than the average distance between the possible positions of the first movable component). This usage is consistent with conventional usage of the term resolution found in the industry. Similarly, where a range is, e.g., from 0 to 1.0", and the possible positions within such range have an average distance between them of ¼", it is said to have a lower or smaller resolution that an range from, e.g., 0 to ¾", with possible positions therein having an average distance between them of ⅛".

Figure 6:
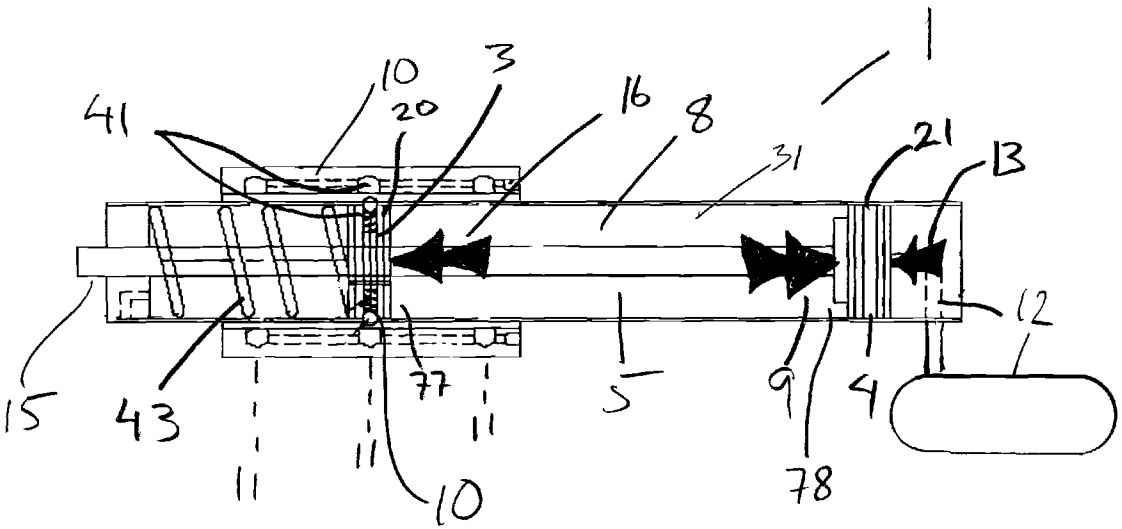
FIG. 6 shows an embodiment of the inventive technology in cross-sectional view.

As relates more particularly to the positioner itself, in certain embodiments, the positioner moves identically with the second movable component, the positioner extends outside of the cylinder, the positioner is a rod, and/or the positioner slidingly passes through the first movable component (see, e.g., FIG. 6). In those embodiments where the positioner slidingly passes through the first movable component, first movable component is between the end of the positioner (whose position is of most concern) and the second movable component. Further, in certain embodiments, second movable component force applier applies a force on the side of the second movable component that is opposite the side of the piston that the elastic force acts on. It is of further note that in certain embodiments, the positioner is identically positionally responsive to the second movable component (such that, e.g., 0.2" of movement of the piston effects 0.2" of movement of the positioner). The positioner may also be identically positionally responsive to the first movable component as well. Additionally, in certain embodiments, when the first movable component is moved, the second movable component moves as well. However, typically, in particular embodiments, when second movable component is moved, the first movable component will move only when the first movable component is not secured in one of its at least two discrete first movable component positions.

Certain of the inventive method embodiments may be described as a positioner method comprising the steps of: establishing a first movable component and a second movable component in cylinder; establishing an elastic element in the cylinder so as to effect an elastic force against the second movable component; configuring a securable position adjustment mechanism to selectively secure the first movable component in at least two discrete first movable component positions within the cylinder at a first movable component movement resolution; configuring a second movable component force applier to apply a second movable component force that acts against the elastic force so as to move the second movable component at a second movable component movement resolution; and establishing a positioner to be positionally responsive to the second movable component, wherein the second movable component movement resolution is greater than the first movable component movement resolution. Certain steps of establishing and configuring as used herein may be accomplished, e.g., during manufacture of the apparatus or perhaps during installation.

Certain inventive method embodiments may be described as a positioner method comprising the steps of: establishing a first movable component and a second movable component in a cylinder; configuring a securable position adjustment mechanism to selectively secure) as necessary for proper positioner position) the first movable component in at least two discrete first movable component positions within the cylinder at a first movable component movement resolution; establishing an elastic element within the cylinder so as to effect an elastic force against the second movable component; configuring a second movable component force applier to apply a second movable component force that acts against the elastic force so as to move the second movable component at a second movable component movement resolution; and establishing a positioner to be positionally responsive to the second movable component, wherein, when the first movable component is secured in any one of the at least two discrete first movable component positions, the second movable component is movable both towards the first movable component and away from the first movable component.

In certain embodiments, the step of establishing a first moving component and a second moving component in a cylinder may include the step of establishing no other moving components (e.g., no other pistons) in the cylinder. In certain embodiments, the step of establishing an elastic element in the cylinder may comprise the step of establishing an elastic element that has two ends that are each translationally movable along a length of the cylinder (when the cylinder itself is stationary).

Particular embodiments may further comprise the step of configuring the second movable component force applier (e.g., during manufacture and/or installation) to apply a first movable component force that moves the first movable component from one of the at least two discrete first movable component positions to another at the first movable component movement resolution. The step of configuring the second movable component force applier may comprise the step of configuring a pneumatic force applier.

In particular embodiments, the step of configuring a securable position adjustment mechanism comprises the step of configuring a first movable component force applier that is distinct from the second movable component force applier, to apply a first movable component force that moves the first movable component from one of the at least two discrete first movable component positions to another at the first movable component movement resolution.

In particular embodiments, the step of establishing an elastic element comprises the step of establishing a helical spring, establishing a control volume of air (or other gas), or indeed establishing any substance (whether fluid, solid or gaseous) or device that, preferably, has an elastic deformation response to a force acting on it (whether it behaves according to Hooke's Law (i.e., linearly), or otherwise). The step of establishing an elastic element may comprise the step of establishing an elastic element between the first movable component and the second movable component (or, instead on either side, where a central rod (e.g. a positioner rod), passes through the first movable component).

The step of configuring a securable position adjustment mechanism may comprise the step of configuring a mechanical securable position adjustment mechanism. Such step itself may comprise the step of configuring a spring and dedicated force applier mechanism; such step may include the step of configuring at least two first movable component movement obstacles, a shuttle mechanism, or a ratchet mechanism (as but a few of many possibilities). The step of configuring a securable position adjustment mechanism may comprise the step of configuring an electrical securable position adjustment mechanism.

The step of establishing a positioner may comprise one or more of the steps of: establishing a positioner that moves identically with the second movable component; establishing a positioner that extends outside of the cylinder; establishing a positioner rod; and establishing a positioner that slidingly passes through the first movable component.

Particular embodiments of the inventive methods may be described as a positioning method that comprises the steps of: establishing in a first stationary position (e.g., one of the at least two discrete first movable component positions) a first movable component that is within a cylinder; then, while the first movable component is in the first stationary position, controllably moving a second movable component so as to achieve proper position of a positioner within a first operational run positional range 50 and with a positioner movement resolution, the positioner positionally responsive to the second movable component; conducting a first operational run with the first movable component in the first stationary position and the positioner positionally within the first run positional range; then, moving the first movable component to a second stationary position (e.g., a different one of the at least two discrete first movable component positions); then, while the first movable component is in the second stationary position, controllably moving the second movable component so as to achieve proper position of the positioner within a second operational run positional range 52 with the positioner movement resolution; and conducting a second operational run with the first movable component in the second stationary position and the positioner positionally within the second run positional range. Such may be a type of alternating movement of the first and second movable components, where run preparation (whether from startup, shutdown, or for, e.g., a different bottle size in a bottle processing operation) may require alternating movement from the first movable component to the second movable component (e.g., where the first movable component is in proper position such that the second movable component can be controllably moved to achieve the desired positioning of the positioner, whether at a first, startup run, or for a second, different run), or from the second movable component to the first movable component (e.g., after an operation run is complete, for example, during operational shutdown, or in order to prepare for a different run having a different positioner position range requirement). Such steps of establishing are typically performed during operation of the apparatus, after installation of the manufactured apparatus; they may be done via manual or, preferably, computer control (e.g., where a microprocessor, perhaps from commands from user (or from feedback control, as particularly relates to movement of the second movable component).

The step of conducting a first operational run may be performed during operational processing (e.g., bottle processing) that requires the postitioner be in a first operational run positioner range (e.g., from 1.2"-1.3") in order that processing be achieved as appropriate (e.g., bottles are controllably conveyed damage free and fed into processing stations such that such stations can process the bottles as intended). It is of note that bottle processing is not the only application of the inventive technology. The step of conducting a first operational run may be performed while performing the step of controllably moving a second movable component (such would be found as where a feedback system assures, at appropriate time intervals) so as to achieve proper positioning of the positioner within a first operational run positioner range. Such would typically involve a repetitive check positioner position and update positioner position as would be afforded by a feedback system, as discussed herein.

In particular embodiments, the step of controllably moving a second movable component may comprise the step of acting against an elastic force (e.g., one applied by a helical spring (a helical spring force), by a control volume, or other type of elastic element).

In particular embodiments, the first stationary position and the second stationary position together exhibit a first movable component movement resolution, and the first movable component movement resolution may be less than the positioner movement resolution. In certain embodiments, the second operational run positional range has the positioner movement resolution. It is of further note that in particular embodiments, the step of moving the first movable component to a second stationary position comprises the step of translationally (e.g., from left to right or right to left if the cylinder is in a horizontal orientation) moving both ends of the elastic element in the same direction.

In certain embodiments, the step of controllably moving the second movable component comprises the step of pneumatically moving the second movable component, and the step of moving the first movable component may comprise the step of pneumatically moving the first movable component.

It is of note that certain embodiments may utilize an electronic eye or other type of position sensor in a feedback system that automatically adjusts pneumatic pressure in order to change position of a piston as necessary, particularly where such piston effects a direct change in position of the positioner. For example, a feedback system could be used to assure that the positioner was within 1 mm of a certain desired position; deviations therefrom could be detected by a position sensor and, perhaps through simple microprocessor control, substantially eliminated (to an acceptable degree) by appropriate increases or reductions in pneumatic pressure. Such a system would typically be used at the second movable component (which typically has a higher, or greater, resolution than that of the first movable component).

At least one embodiment of the inventive technology may be described as a positioner apparatus that comprises: a cylinder; a first movable component and a second movable component established in the cylinder; an elastic element established within the cylinder so as to effect an elastic force against the second movable component; a securable position adjustment mechanism configured to selectively secure the first movable component in at least two discrete first movable component positions within the cylinder at a first movable component movement resolution; a second movable component force applier configured to apply a second movable component force that acts against the elastic force so as to move the second movable component at a second movable component movement resolution; and a positioner that is positionally responsive to the second movable component, wherein the elastic element has two ends (one that is closer to a first end of the cylinder and the other that is closer to a second end of the cylinder) that are each translationally movable along a length of the cylinder. Often, such ends are simultaneously movable (e.g., during movement of the first movable component to a new discrete stationary position). In any of such embodiments: the second movable component movement resolution may be greater than the first movable component movement resolution; when the first movable component is secured in any one of the at least two discrete first movable component positions, the second movable component may be movable both towards the first movable component and away from the first movable component; and/or the positioner may be movable to intermediate positions between any two proximate positioner positions of the at least two corresponding discrete positioner positions.

At least one embodiment of the inventive technology may be described as a positioner method that comprises the steps of: establishing a first movable component and a second movable component in cylinder; establishing an elastic element in the cylinder so as to effect an elastic force against the second movable component; configuring a securable position adjustment mechanism to selectively secure the first movable component in at least two discrete first movable component positions within the cylinder at a first movable component movement resolution; configuring a second movable component force applier to apply a second movable component force that acts against the elastic force so as to move the second movable component at a second movable component movement resolution; and establishing a positioner to be positionally responsive to the second movable component, wherein the step of establishing an elastic element in the cylinder comprises the step of establishing an elastic element that has two ends that are each translationally movable (often simultaneously) along a length of the cylinder. In particular embodiments: the the second movable component movement resolution may be greater than the first movable component movement resolution; when the first movable component is secured in any one of the at least two discrete first movable component positions, the second movable component is movable both towards the first movable component and away from the first movable component; and/or the positioner is movable to intermediate positions between any two proximate positioner positions of the at least two corresponding discrete positioner positions.

As mentioned earlier, the present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

As can be easily understood from the foregoing, the basic concepts of the present invention may be embodied in a variety of ways. It involves both positioning techniques as well as devices to accomplish the appropriate position. In this application, the positioning techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "position" should be understood to encompass disclosure of the act of "positioning"—whether explicitly discussed or not—and, conversely, were there effectively disclosure of the act of "positioning", such a disclosure should be understood to encompass disclosure of a "position" and even a "means for positioning" Such changes and alternative terms are to be understood to be explicitly included in the description.

Any acts of law, statutes, regulations, or rules mentioned in this application for patent; or patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Provisional Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the multipositioner devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim* v. *Cannon Avent Group*, PLC, 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. As one clarifying example, if a claim were dependent "on claim 20 or any other claim" or the like, it could be re-drafted as dependent on claim 1, claim 15, or even claim 715 (if such were to exist) if desired and still fall with the disclosure. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A positioner apparatus comprising:

a cylinder;

a first movable component and a second movable component established in said cylinder;

an elastic element established within said cylinder so as to effect an elastic force against said second movable component;

a securable position adjustment mechanism configured to selectively secure said first movable component in at least two discrete first movable component positions within said cylinder at a first movable component movement resolution;

a second movable component force applier configured to apply a second movable component force that acts against said elastic force so as to move said second movable component at a second movable component movement resolution; and a positioner that is positionally responsive to said second movable component, wherein said second movable component movement resolution is greater than said first movable component movement resolution, and wherein said second movable component force applier is also configured to apply a first movable component force that moves said first movable component from one of said at least two discrete first movable component positions to another.

2. A positioner apparatus as described in claim 1 wherein said first and second movable components are pistons, and are the only pistons established in said cylinder.

3. A positioner apparatus as described in claim 1 wherein said securable position adjustment mechanism comprises a first movable component force applier that is distinct from said second movable component force applier and that applies a first movable component force that moves said first movable component from one of said at least two discrete first movable component positions to another at said first movable component movement resolution, and wherein said first movable component force applier comprises a pneumatic force applier.

4. A positioner apparatus as described in claim 1 wherein said elastic element comprises a helical spring.

5. A positioner apparatus as described in claim 1 wherein said elastic element comprises a control volume of air.

6. A positioner apparatus as described in claim 1 wherein said elastic element has two ends that are each translationally movable along a length of said cylinder.

7. A positioner apparatus as described in claim 1 wherein said second movable component force applier comprises a pneumatic force applier.

8. A positioner apparatus as described in claim 1 wherein, when said first movable component is secured in any one of said at least two discrete first movable component positions, said second movable component is movable both towards said first movable component and away from said first movable component.

9. A positioner apparatus as described in claim 1 wherein movement of said first movable component to said at least two discrete first movable component positions effects movement of said positioner to at least two corresponding discrete positioner positions and wherein said positioner is movable to intermediate positions between any two proximate positioner positions of said at least two corresponding discrete positioner positions.

10. A positioner apparatus as described in claim 1 wherein said first movable component is a first piston.

11. A positioner apparatus as described in claim 1 wherein said first movable component is a cylinder end portion.

12. A positioner apparatus as described in claim 11 wherein said cylinder is a telescoping cylinder.

13. A positioner apparatus as described in claim 1 wherein said second movable component is a second piston.

14. A positioner apparatus as described in claim 1 wherein said first movable component is a first piston and said second movable component is a second piston.

15. A positioner apparatus comprising:

a cylinder;

a first movable component and a second movable component established in said cylinder;

an elastic element established within said cylinder so as to effect an elastic force against said second movable component;

a securable position adjustment mechanism configured to selectively secure said first movable component in at least two discrete first movable component positions within said cylinder at a first movable component movement resolution;

a second movable component force applier configured to apply a second movable component force that acts against said elastic force so as to move said second movable component at a second movable component movement resolution; and a positioner that is positionally responsive to said second movable component, wherein said second movable component movement resolution is greater than said first movable component movement resolution, and wherein said positioner slidingly passes through said first movable component.

16. A positioner apparatus comprising:

a cylinder;

a first movable component and a second movable component established in said cylinder;

an elastic element established within said cylinder so as to effect an elastic force against said second movable component;

a securable position adjustment mechanism configured to selectively secure said first movable component in at least two discrete first movable component positions within said cylinder at a first movable component movement resolution;

a second movable component force applier configured to apply a second movable component force that acts against said elastic force so as to move said second movable component at a second movable component movement resolution; and a positioner that is positionally responsive to said second movable component, wherein said second movable component movement resolution is greater than said first movable component movement resolution, and wherein said second movable component is a cylinder end portion.

17. A positioner apparatus as described in claim 16 wherein said cylinder is a telescoping cylinder.

18. A positioner method comprising the steps of:

establishing a first movable component and a second movable component in cylinder;

establishing an elastic element in said cylinder so as to effect an elastic force against said second movable component;

configuring a securable position adjustment mechanism to selectively secure said first movable component in at least two discrete first movable component positions within said cylinder at a first movable component movement resolution;

configuring a second movable component force applier to apply a second movable component force that acts against said elastic force so as to move said second movable component at a second movable component movement resolution;

establishing a positioner to be positionally responsive to said second movable component; and configuring said second movable component force applier to apply a first movable component force that moves said first movable component from one of said at least two discrete first movable component positions to another at said first movable component movement resolution, wherein said second movable component movement resolution is greater than said first movable component movement resolution.

19. A positioner method as described in claim 18 wherein said step of establishing a first movable component and a second movable component in a cylinder comprises the step of establishing two pistons, and only two pistons, in said cylinder.

20. A positioner method as described in claim 18 wherein said step of configuring a securable position adjustment mechanism comprises the step of configuring a first movable component force applier that is distinct from said second movable component force applier, to apply a first movable component force that moves said first movable component from one of said at least two discrete first movable component positions to another at said first movable component movement resolution.

21. A positioner method as described in claim 18 wherein said step of establishing an elastic element comprises the step of establishing a helical spring.

22. A positioner method as described in claim 18 wherein said step of establishing an elastic element comprises the step of establishing a control volume of air.

23. A positioner method as described in claim 18 wherein said step of establishing an elastic element in said cylinder comprises the step of establishing an elastic element that has two ends that are each translationally movable along a length of said cylinder.

24. A positioner method as described in claim 18 wherein said step of establishing an elastic element comprises the step of establishing an elastic element between said first movable component and said second movable component.

25. A positioner method as described in claim 18 wherein said step of establishing a first movable component and a second movable component in a cylinder comprises the step of establishing a first piston and a second movable component in a cylinder.

26. A positioner method as described in claim 18 wherein said step of establishing a first movable component and a second movable component in a cylinder comprises the step of establishing a cylinder end portion and a second movable component in a cylinder.

27. A positioner method as described in claim 26 wherein said cylinder is a telescoping cylinder.

28. A positioner method as described in claim 18 wherein said step of establishing a first movable component and a second movable component in a cylinder comprises the step of establishing a first movable component and a second piston in a cylinder.

29. A positioner method as described in claim 18 wherein said step of establishing a first movable component and a second movable component in a cylinder comprises the step of establishing a first movable component and a cylinder end portion in a cylinder.

* * * * *